US010873824B2

(12) United States Patent
Okuma

(10) Patent No.: US 10,873,824 B2
(45) Date of Patent: Dec. 22, 2020

(54) APPARATUS, SYSTEM, AND METHOD OF PROCESSING DATA, AND RECORDING MEDIUM

(71) Applicant: Takafumi Okuma, Kanagawa (JP)

(72) Inventor: Takafumi Okuma, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 16/509,670

(22) Filed: Jul. 12, 2019

(65) Prior Publication Data

US 2019/0342692 A1 Nov. 7, 2019

Related U.S. Application Data

(63) Continuation of application No. 15/913,098, filed on Mar. 6, 2018, now Pat. No. 10,397,723.

(30) Foreign Application Priority Data

Mar. 7, 2017 (JP) ..... 2017-042385

(51) Int. Cl.

| | |
|---|---|
| ***H04R 5/02*** | (2006.01) |
| ***H04S 7/00*** | (2006.01) |
| ***H04R 1/40*** | (2006.01) |
| ***H04R 3/00*** | (2006.01) |
| ***H04S 3/00*** | (2006.01) |
| *H04R 5/027* | (2006.01) |

(52) U.S. Cl.

CPC ..... *H04S 7/303* (2013.01); *H04R 1/406* (2013.01); *H04R 3/005* (2013.01); *H04S 3/008* (2013.01); *H04R 5/027* (2013.01); *H04S 2400/01* (2013.01); *H04S 2400/11* (2013.01); *H04S 2400/15* (2013.01); *H04S 2420/11* (2013.01)

(58) Field of Classification Search

CPC ..... H04S 7/303; H04S 3/008; H04R 1/405; H04R 3/005

See application file for complete search history.

(56) References Cited

U.S. PATENT DOCUMENTS

| | | | |
|---|---|---|---|
| 5,506,908 | A | 4/1996 | Baumhauer, Jr. et al. |
| 6,683,964 | B1 | 1/2004 | Baumhauer, Jr. et al. |
| 2004/0114777 | A1 | 6/2004 | Aubauer et al. |

(Continued)

FOREIGN PATENT DOCUMENTS

| | | | |
|---|---|---|---|
| CN | 1528104 | A | 9/2004 |
| CN | 101729771 | A | 6/2010 |

(Continued)

OTHER PUBLICATIONS

Communication dated Apr. 12, 2019 by the Chinese Patent Office for Chinese Patent Application No. 201810179802.1.

(Continued)

*Primary Examiner* — Simon King

(74) *Attorney, Agent, or Firm* — Harness, Dickey and Pierce, P.L.C.

(57) ABSTRACT

An apparatus, method, and system each of which obtains sound data based on a plurality of sound signals respectively output from a plurality of microphones, receives a user instruction for enhancing directivity of sensitivity characteristics of at least one of the plurality of microphones in a specific direction, and generates sound data having the directivity in the specific direction, based on the obtained sound data.

17 Claims, 13 Drawing Sheets

(56) References Cited

U.S. PATENT DOCUMENTS

| | | | | |
|---|---|---|---|---|
| 2008/0044033 | A1 | 2/2008 | Ozawa | |
| 2011/0069852 | A1* | 3/2011 | Arndt | H04R 25/48 381/317 |
| 2012/0212057 | A1 | 8/2012 | Okuma | |
| 2012/0274269 | A1 | 11/2012 | Ohkuma | |
| 2013/0275873 | A1 | 10/2013 | Shaw et al. | |
| 2013/0301841 | A1 | 11/2013 | Sakuraba et al. | |
| 2014/0198934 | A1* | 7/2014 | Recker | H04R 25/402 381/313 |
| 2014/0376740 | A1 | 12/2014 | Shigenaga et al. | |
| 2015/0078606 | A1 | 3/2015 | Zhang et al. | |
| 2016/0073024 | A1 | 3/2016 | Yamamoto | |
| 2016/0183014 | A1* | 6/2016 | Guo | G06K 9/00281 381/23.1 |
| 2016/0249134 | A1 | 8/2016 | Wang et al. | |
| 2019/0019295 | A1* | 1/2019 | Lehtiniemi | G06T 7/20 |

FOREIGN PATENT DOCUMENTS

| | | | | |
|---|---|---|---|---|
| CN | 103391490 | A | 11/2013 | |
| CN | 104243779 | A | 12/2014 | |
| CN | 104429049 | A | 3/2015 | |
| CN | 105474665 | A | 4/2016 | |
| JP | 2014-021790 | A | 2/2014 | |
| JP | 2015-220595 | A | 12/2015 | |
| JP | 2016-149733 | A | 8/2016 | |
| WO | WO-2015/151130 | A1 | 10/2015 | |
| WO | WO-2015151130 | A1 * | 10/2015 | H04R 3/005 |

OTHER PUBLICATIONS

Chinese Office Action dated Jun. 28, 2020 for Chinese Patent Application No. CN 201810179802.1.

Japanese Office Action dated Sep. 29, 2020 for Japanese Patent Application No. 2017-042385.

* cited by examiner

APPARATUS, SYSTEM, AND METHOD OF PROCESSING DATA, AND RECORDING MEDIUM

CROSS-REFERENCE TO RELATED APPLICATIONS

This application is a continuation application of U.S. patent application Ser. No. 15/913,098, filed on Mar. 6, 2018, and is based on and claims priority pursuant to 35 U.S.C. § 119(a) to Japanese Patent Application No. 2017-042385, filed on Mar. 7, 2017, in the Japan Patent Office, the entire disclosure of each of which is hereby incorporated by reference herein.

BACKGROUND

Technical Field

The present invention relates to an apparatus, a system, and a method of processing data, and a recording medium.

Description of the Related Art

With the widespread use of spherical cameras, techniques for capturing spherical moving images are developed. In addition, stereophonic sound techniques for reproducing stereophonic sound in accordance with a viewer's line of sight when the viewer views such spherical moving images are known.

For example, there is a technique of recording sound by using a plurality of microphones and of reproducing stereophonic sound. More specifically, an image and stereophonic sound that are to be reproduced are synchronized with each other. Consequently, the stereophonic sound data is successfully output in accordance with a user's point of view and line of sight.

SUMMARY

Example embodiments of the present invention include an apparatus, method, and system each of which obtains sound data based on a plurality of sound signals respectively output from a plurality of microphones, receives a user instruction for enhancing directivity of sensitivity characteristics of at least one of the plurality of microphones in a specific direction, and generates sound data having the directivity in the specific direction, based on the obtained sound data.

Example embodiments of the present invention include a method including: displaying a polar pattern that reflects directivity of sensitivity characteristics of a plurality of microphones; receiving a change in a shape of the polar pattern in response to a user operation on the shape of the polar pattern, as a user instruction for enhancing directivity of sensitivity characteristics of at least one of the plurality of microphones in a specific direction; and outputting sound data having the directivity in the specific direction, based on sound data of a plurality of sound signals respectively output from the plurality of microphones.

BRIEF DESCRIPTION OF THE SEVERAL VIEWS OF THE DRAWINGS

A more complete appreciation of the disclosure and many of the attendant advantages and features thereof can be readily obtained and understood from the following detailed description with reference to the accompanying drawings, wherein.

Figure 1:
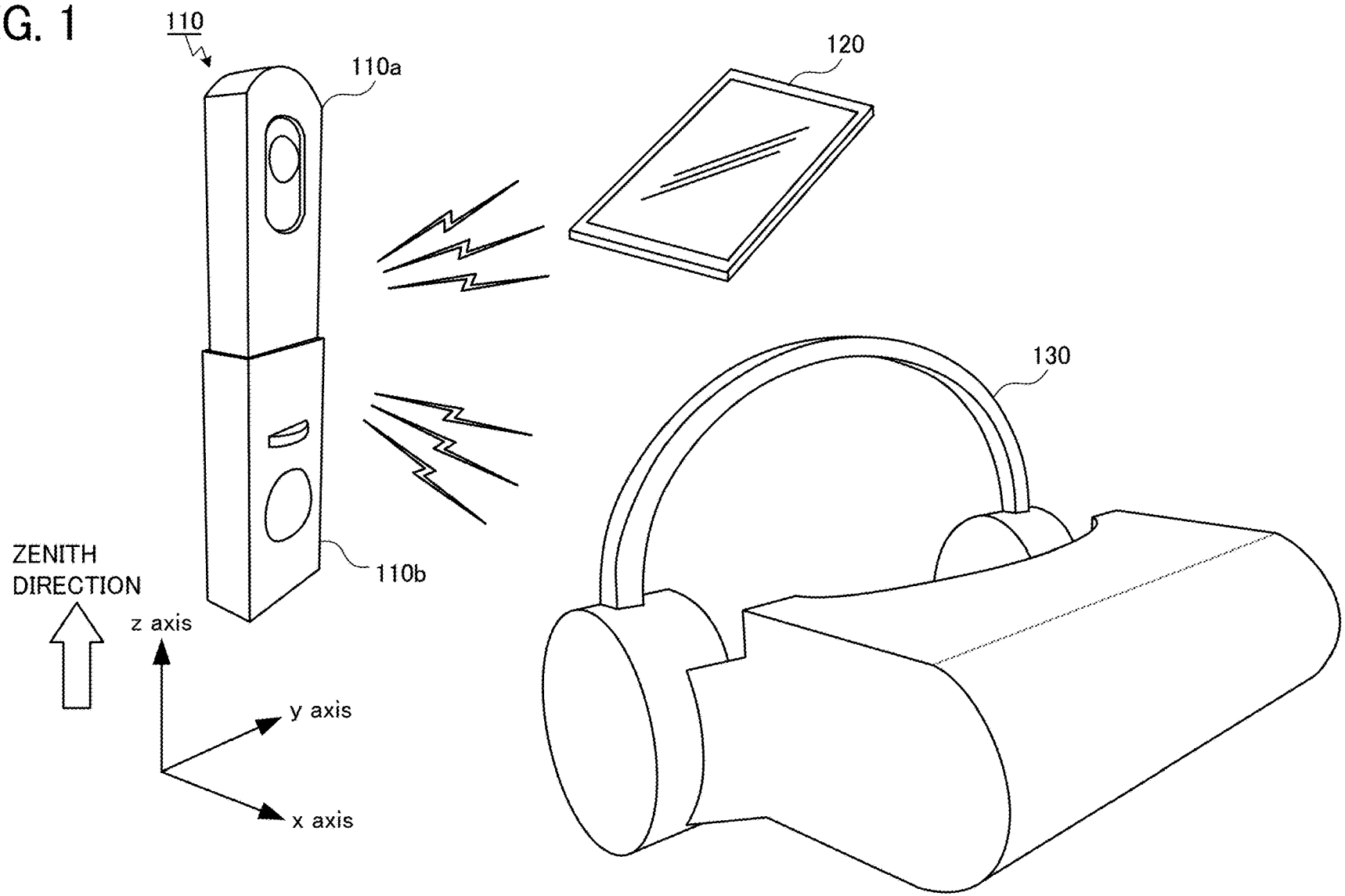
FIG. 1 is a schematic diagram illustrating a hardware configuration of an entire system according to an embodiment of the present invention.

The accompanying drawings are intended to depict embodiments of the present invention and should not be interpreted to limit the scope thereof. The accompanying drawings are not to be considered as drawn to scale unless explicitly noted.

DETAILED DESCRIPTION

The terminology used herein is for describing particular embodiments only and is not intended to be limiting of the present invention. As used herein, the singular forms "a", "an" and "the" are intended to include the plural forms as well, unless the context clearly indicates otherwise.

In describing embodiments illustrated in the drawings, specific terminology is employed for the sake of clarity. However, the disclosure of this specification is not intended to be limited to the specific terminology so selected and it is to be understood that each specific element includes all technical equivalents that have a similar function, operate in a similar manner, and achieve a similar result.

Although an embodiment of the present invention will be described below, the present invention is not limited to the embodiment described below. Note that elements illustrated in common in the drawings referred to below are denoted by the same reference signs to appropriately omit a description thereof. In addition, hereinafter, the term "sound" refers not only to voice emitted by a person but also to music, machine sound, operation sound, and other sound that propagates as a result of vibration of air.

FIG. 1 is a schematic diagram illustrating a hardware configuration of an entire system according to an embodiment of the present invention. FIG. 1 illustrates an environment including a spherical camera system 110, a user terminal 120, and a head-mounted display 130. The spherical camera system 110 includes a spherical camera 110*a* and an external microphone 110*b* connected to the spherical camera 110*a*. Note that the hardware components illustrated in FIG. 1 can be connected to each other by wireless or wired communication to transmit and receive various kinds of data, such as setting data and captured image data, to and from each other. In addition, the number of hardware components is not limited to the number of devices illustrated in FIG. 1. That is, the number of hardware components included in the system is not limited.

The spherical camera 110*a* according to the embodiment, which is an example of a data processing apparatus, includes a plurality of image forming optical systems. The spherical camera 110*a* is capable of combining images captured with the respective image forming optical systems together to capture a spherical image having a solid angle of 4π steradians. In addition, the spherical camera 110*a* is capable of continuously capturing spherical images. That is, the spherical camera 110*a* is capable of capturing a spherical moving image. The spherical camera 110*a* is also capable of acquiring sound in the surrounding image-capturing environment by using a microphone unit included in the spherical camera system 110 when capturing a spherical moving image.

Sound acquired by the spherical camera system 110 can be provided as stereophonic sound. With such stereophonic sound, a video image having an enhanced sense of realism can be provided to the user. In addition, when stereophonic sound is acquired, the user is allowed to adjust the sensitivity characteristics of each microphone unit to enhance sound in a direction desired by the user for acquisition. By adjusting the directivity of each microphone unit in this way, a sense of realism or an expression unique to the user can be further added. Note that the microphone unit included in the spherical camera system 110 may be a microphone built in the spherical camera 110*a*, may be the external microphone 110*b* connected to the spherical camera 110*a*, or may be a combination of the built-in microphone and the external microphone 110*b*.

Examples of the user terminal 120 according to the embodiment include a smartphone, a tablet, and a personal computer. The user terminal 120 is an apparatus that is capable of communicating with the spherical camera system 110 wirelessly or with a cable and that is used to make image-capturing settings and to display captured images. An application, which is installed on the user terminal 120, allows the user to perform an operation for making settings in the spherical camera system 110 and an operation for displaying images captured by the spherical camera 110*a*. Although a description is given in the embodiment below on the assumption that the user terminal 120 has a function for making settings in the spherical camera system 110, this assumption does not limit the embodiment. For example, the spherical camera system 110 may include a screen, through which various operations may be performed.

Figure 2:
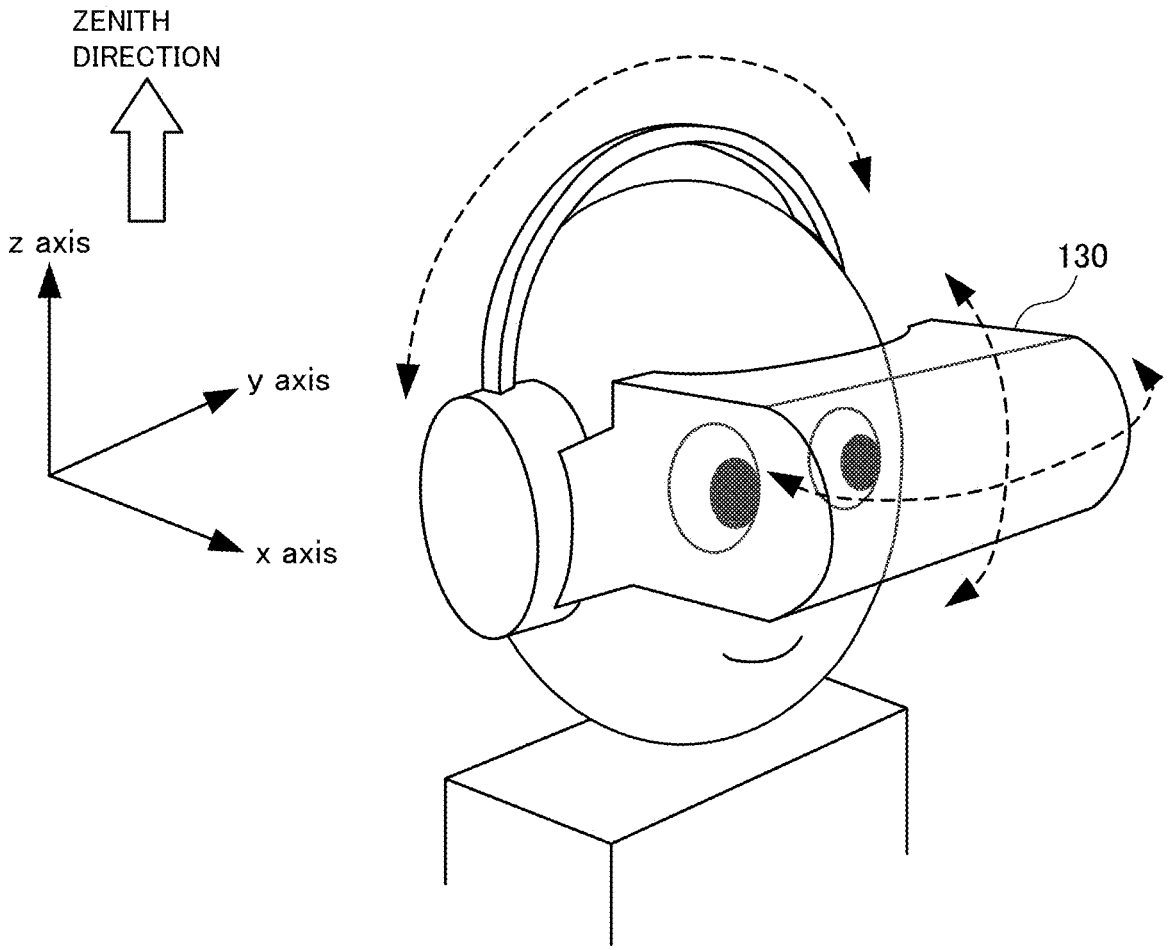
FIG. 2 is a diagram illustrating a user wearing a head-mounted display.

The head-mounted display 130 according to the embodiment is an apparatus used to view spherical images such as spherical moving images. An example in which images captured by the spherical camera 110*a* are displayed on the user terminal 120 has been described above. However, the images may be displayed on a reproduction apparatus such as the head-mounted display 130 to provide a viewing environment with an enhanced sense of realism. The head-mounted display 130 is an apparatus that includes a monitor and speakers and that is worn on the user's head. FIG. 2 is a diagram illustrating the user wearing the head-mounted display 130.

As illustrated in FIG. 2, the monitor of the head-mounted display 130 is provided to be located around the eyes of the user, and the speakers of the head-mounted display 130 are provided to be placed on the respective ears of the user. The monitor is capable of displaying a wide-view image that is clipped from the spherical image to match the user's field of vision. The speakers are capable of outputting sound recorded during capturing of the spherical moving image. In particular, the speakers are capable of outputting stereophonic sound.

The head-mounted display 130 according to the embodiment includes a sensor that detects the posture of the user, such as a motion sensor. For example, the head-mounted display 130 is capable of changing an image to be displayed in accordance with a motion of the user's head as indicated by a dash-line arrow illustrated in FIG. 2. In this way, the user can have a sense of realism as if the user were actually at the place where the image was captured. In addition, stereophonic sound output from the speakers of the head-mounted display 130 can also be reproduced in accordance with the user's field of vision. For example, when the user moves their head to move the line of sight, the speakers are able to enhance and output sound from a sound source located in the direction of the line of sight. Since the user can view and listen to the image and the sound in accordance with the change in the line of sight in this way, the user can view a moving image with a sense of realism.

The following description will be given on the assumption that the front-rear direction, the left-right direction, and the top-bottom direction of the spherical camera 110*a* or the user respectively correspond to an x-axis, a y-axis, and a z-axis as illustrated in FIGS. 1 and 2. In addition, a vertical direction that is independent of the directional axes and that is not dependent of the position of the spherical camera 110*a* and of the posture of the user is referred to as a zenith direction. Specifically, the zenith direction, which is an example of a reference direction, is a direction right above the user on the sphere and matches a direction opposite to the vertical direction. In the embodiment, an inclination angle of the spherical camera 110*a* relative to the zenith direction indicates an inclination of the direction along a plane opposing each image forming optical system of the spherical camera 110*a* relative to the zenith direction. Thus, when the spherical camera 110*a* is used in a default position without being inclined, the zenith direction matches the z-axis direction.

Figure 3:
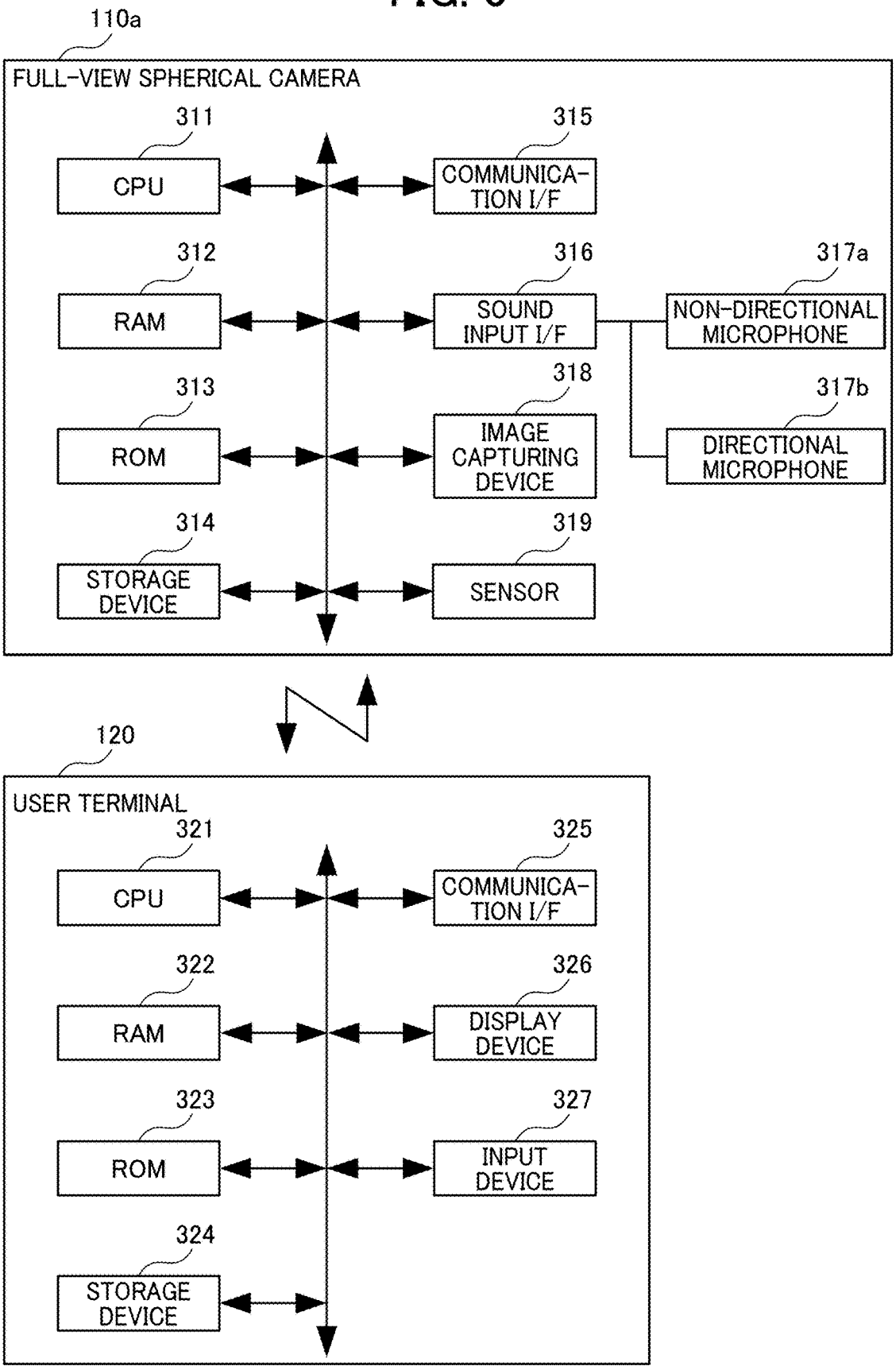
FIG. 3 is a diagram illustrating hardware configurations of a spherical camera and a user terminal according to the embodiment.

The schematic hardware configuration according to the embodiment of the present invention has been described above. Detailed hardware configurations of the spherical camera 110*a* and the user terminal 120 will be described next. FIG. 3 is a diagram illustrating hardware configurations of the spherical camera 110*a* and the user terminal 120 according to the embodiment. The spherical camera 110*a* includes a central processing unit (CPU) 311, a random access memory (RAM) 312, a read-only memory (ROM) 313, a storage device 314, a communication interface (I/F) 315, a sound input I/F 316, an image capturing device 318, and a sensor 319, which are connected to one another via a bus. The user terminal 120 includes a CPU 321, a RAM 322, a ROM 323, a storage device 324, a communication I/F 325, a display device 326, and an input device 327, which are connected to one another via a bus.

The configuration of the spherical camera 110*a* will be described first. The CPU 311 controls entire operations of the spherical camera 110*a* according to a control program. The RAM 312 is a volatile memory that provides an area for the spherical camera 110*a* to deploy the control program or to store data to be used for execution of the control program. The ROM 313 is a non-volatile memory that stores a control program to be executed by the spherical camera 110*a* and data, for example.

The storage device 314 is a non-volatile readable-writable memory that stores an operating system and applications that cause the spherical camera 110*a* to function, various kinds of setting information, and captured image data and sound data, for example. The communication I/F 315 is an interface that enables the spherical camera 110*a* to communicate with other apparatuses such as the user terminal 120 and the head-mounted display 130 in compliance with a predetermined communication protocol to transmit and receive various kinds of data.

The sound input I/F 316 is an interface for connecting the microphone unit used to acquire and record sound when a moving image is captured. The microphone unit connected to the sound input I/F 316 can include at least one of a non-directional microphone 317*a* that does not have a directivity of sensitivity characteristics in a particular direction and a directional microphone 317*b* having a directivity of sensitivity characteristics in a particular direction. Alternatively, the microphone unit may include both the non-directional microphone 317*a* and the directional microphone 317*b*. The sound input I/F 316 is used to connect the external microphone 110*b* to the spherical camera 110*a* in addition to the microphone unit (hereinafter, referred to as a "built-in microphone") built in the spherical camera 110*a*.

Adjustment of the directivities of the built-in microphone of the spherical camera 110*a* and the external microphone 110*b* allows the spherical camera system 110 according to the embodiment to acquire sound with emphasis on a direction desired by the user. In addition, the microphone unit according to the embodiment includes at least four microphones therein. With the four microphones, the directivity of sensitivity characteristics of the entire microphone unit is determined. Note that details about acquisition of stereophonic sound will be described later.

The image capturing device 318 includes at least two image forming optical systems that together capture a spherical image in the embodiment. The image capturing device 318 is capable of combining images captured with the respective image forming optical systems together to generate a spherical image. The sensor 319, which is for example an angular rate sensor such as a gyro sensor, detects an inclination of the spherical camera 110*a* and outputs the detected inclination as position data. The sensor 319 is also capable of calculating the vertical direction by using the detected inclination information and of performing zenith correction on a spherical image.

The spherical camera 110*a* is capable of storing image data, sound data, and position data in association with one another during image capturing. Using these various kinds of data, a video image can be reproduced in accordance with a motion of the user when the user views the image by using the head-mounted display 130.

The user terminal 120 will be described next. The CPU 321, the RAM 322, the ROM 323, the storage device 324, and the communication I/F 325 of the user terminal 120 operate in a substantially similar manner as described above referring to the CPU 311, the RAM 312, the ROM 313, the storage device 314, and the communication I/F 315 of the spherical camera 110*a* described above. Since the CPU 321, the RAM 322, the ROM 323, the storage device 324, and the communication I/F 325 have substantially the same functions as the CPU 311, the RAM 312, the ROM 313, the storage device 314, and the communication I/F 315, respectively, a description thereof is omitted.

The display device 326 displays, for example, the status of the user terminal 120 and operation screens to the user. The display device 326 is, for example, a liquid crystal display (LCD). The input device 327 receives a user instruction to the user terminal 120 from the user. Examples of the input device 327 include a keyboard, a mouse, and a stylus. In addition, the input device 327 may be a touch panel display that also has a function of the display device 326. Although a description will be given using a smartphone including a touch panel display as an example of the user terminal 120 according to the embodiment, this example does not limit the embodiment.

Figure 4:
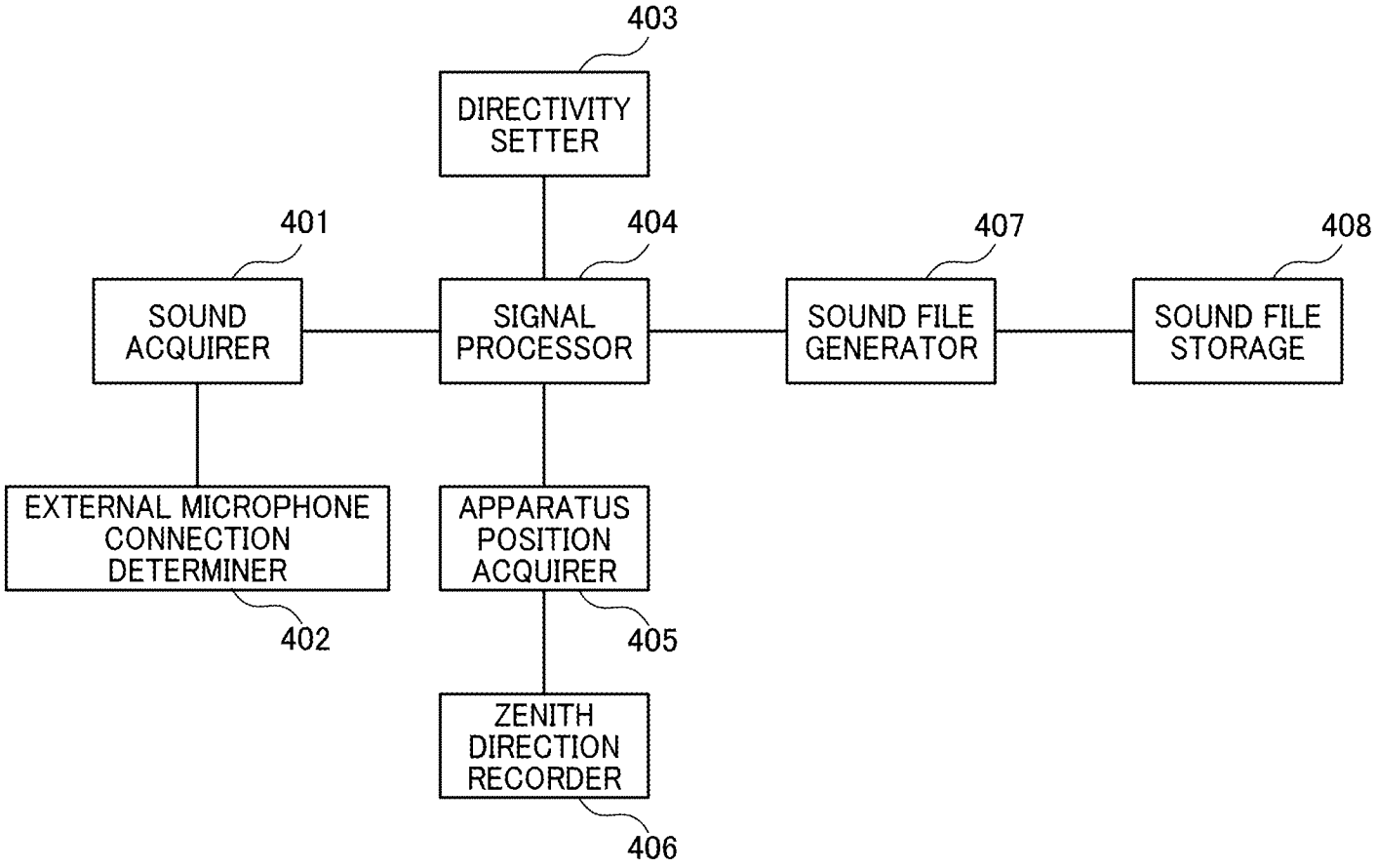
FIG. 4 is a diagram illustrating a functional configuration of the spherical camera according to the embodiment.

The hardware configurations of the spherical camera 110*a* and the user terminal 120 according to the embodiment have been described above. Next, a functional configuration implemented by the respective hardware components in the embodiment will be described with reference to FIG. 4. FIG. 4 is a diagram illustrating the functional configuration of the spherical camera 110*a* according to the embodiment.

The spherical camera 110*a* includes various functional blocks such as a sound acquirer 401, an external microphone connection determiner 402, a directivity setter 403, a signal processor 404, an apparatus position acquirer 405, a zenith information recorder 406, a sound file generator 407, and a sound file storage 408. The various functional blocks will be described below.

The sound acquirer 401 outputs sound acquired by the built-in microphone and the external microphone 110*b* as sound data. The sound acquirer 401 is also capable of performing various kinds of processing on the acquired sound and, consequently, of outputting the resultant sound data. The sound data output by the sound acquirer 401 is supplied to the signal processor 404.

The external microphone connection determiner 402 determines whether the external microphone 110*b* is connected to the spherical camera 110*a*. The determination result obtained by the external microphone connection determiner 402 as to whether the external microphone 110*b* is connected is output to the sound acquirer 401. When the external microphone 110*b* is connected to the spherical camera 110*a*, the sound acquirer 401 acquires sound data from the external microphone 110*b* in synchronization with sound data from the built-in microphone.

The directivity setter 403 sets the directivities of sensitivity characteristics of the built-in microphone and the external microphone 110*b*. For example, the directivity setter 403 is able to set the directivity in response to an input from an application installed on the user terminal 120. For example, the directivity can be set when the user changes the shape of a polar pattern displayed on an operation screen to enhance the directivity in a particular direction. The directivity setter 403 outputs, to the signal processor 404, the set directivity of sensitivity characteristics as directivity selection information.

The signal processor 404 performs processing such as various kinds of correction on the sound data output by the sound acquirer 401 and outputs the resultant sound data to the sound file generator 407. The signal processor 404 is also capable of combining or converting the directivities by using, as parameters, the directivity selection information output by the directivity setter 403. The signal processor 404 is further capable of combining or converting the directivities in consideration of the inclination of the spherical camera 110*a* by using the position data output by the apparatus position acquirer 405 and the zenith information recorder 406.

The apparatus position acquirer 405 acquires an inclination of the spherical camera 110*a* detected by the sensor 319 as position data. The zenith information recorder 406 records the inclination of the spherical camera 110*a* by using the position data acquired by the apparatus position acquirer 405. Since the apparatus position acquirer 405 and the zenith information recorder 406 acquire the position of the spherical camera 110*a* to allow zenith correction to be appropriately performed on a spherical image, unnaturalness the user feels when an image is reproduced is reduced even if the spherical camera 110*a* was inclined or rotated during image capturing. Further, corrections can be performed in the similar manner when sound data is acquired. For example, the directivity of sensitivity characteristics is successfully maintained in a direction of a sound source desired by the user even if the spherical camera 110*a* was rotated during sound recording.

The sound file generator 407 generates a sound file of the sound data processed by the signal processor 404 in a format reproducible by various reproduction apparatuses. The sound file generated by the sound file generator 407 can be output as a stereophonic sound file. The sound file storage 408 stores the sound file generated by the sound file generator 407 in the storage device 314.

The above-described functional units are implemented by the CPU 311 executing a program according to the embodiment using the respective hardware components. In addition, all the functional units described in the embodiment may be implemented by software or some or all of the functional units can also be implemented as hardware components that provide the equivalent functions.

Figure 5:
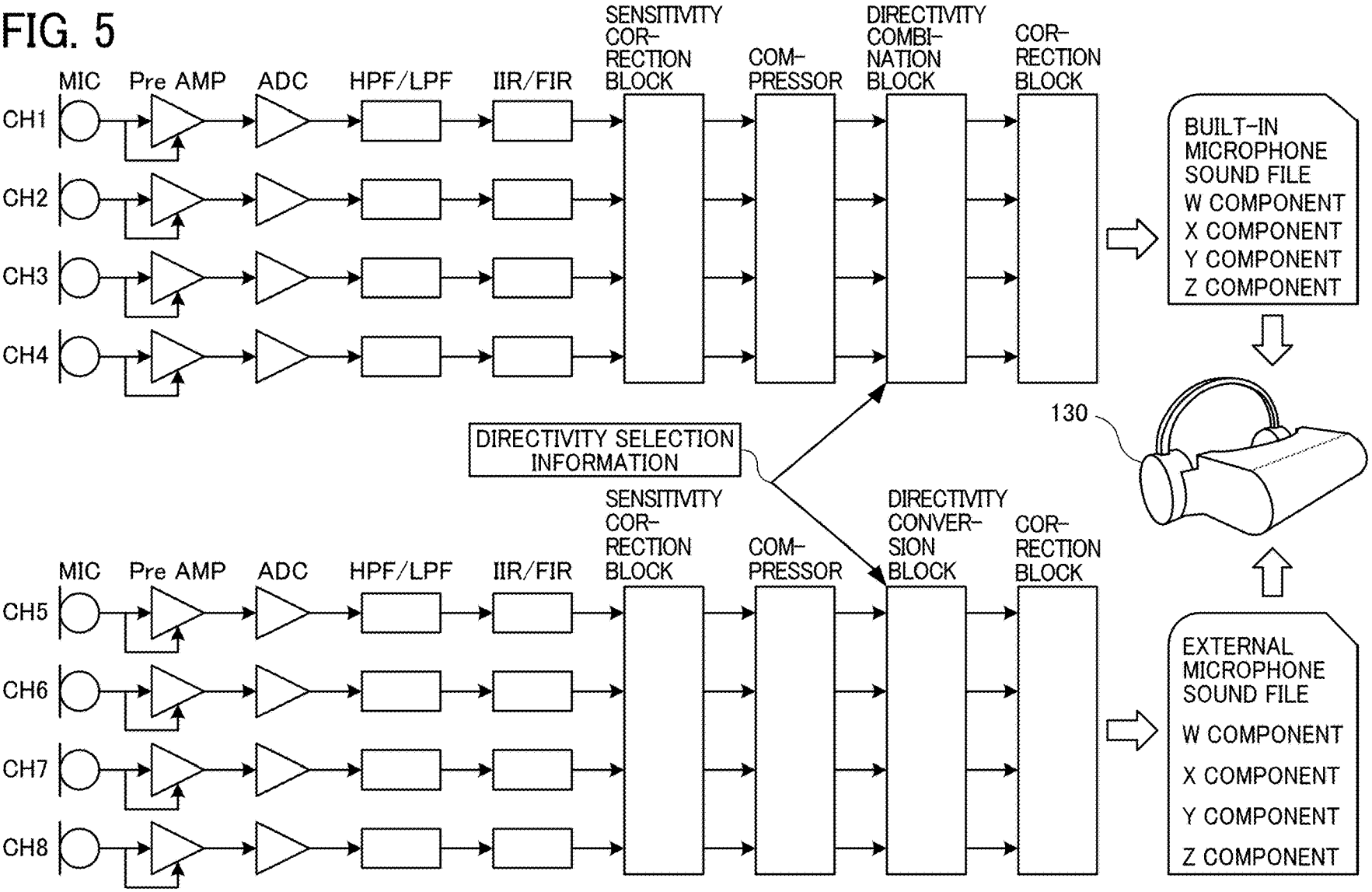
FIG. 5 is a diagram illustrating a configuration of a circuit or software that generates stereophonic sound data at the time of image capturing, according to the embodiment.

The functional configuration of the spherical camera 110*a* according to the embodiment has been described above. FIG. 5 is a diagram illustrating a configuration of a circuit that processes generation of stereophonic sound data at the time of image capturing. Each block in FIG. 5 corresponds to a circuit, or a process performed with software, or a combination of circuit and software.

The configuration illustrated in FIG. 5 operates as the sound acquirer 401, the signal processor 404, and the sound file generator 407 illustrated in FIG. 4. FIG. 5 illustrates a case where the external microphone 110*b* including directional microphones is connected to the spherical camera 110*a* including the built-in microphone including non-directional microphones, for example. Specifically, the built-in microphone is a non-directional microphone unit that includes microphones CH1 to CH4 (upper portion in FIG. 5), whereas the external microphone 110*b* is a directional microphone unit including microphones CH5 to CH8 (lower portion in FIG. 5). FIG. 5 illustrates the built-in microphone that is a non-directional microphone unit and the external microphone 110*b* that is a directional microphone unit. However, this configuration is merely an example. The built-in microphone and the external microphone 110*b* may have a combination other than this combination, or the external microphone 110*b* may not be connected.

Processing of sound signals output from the built-in microphone will be described with reference to the upper portion in FIG. 5. The level of a sound signal input from each of the microphones (MIC) CH1 to CH4 is amplified by a preamplifier (Pre AMP). Since the level of a signal input from a microphone is low in general, the signal is amplified by a preamplifier at a predetermined gain to allow the signal to have a level that is easy-to-handle by a circuit that performs the following processing. In addition, the preamplifier may perform impedance conversion.

The sound signal (analog signal) amplified by the preamplifier is then digitized by an analog-to-digital converter (ADC). Then, processing such as frequency separation is performed on the digital sound signal by using various filters such as a high-pass filter (HFP), a low-pass filter (LPF), an infinite impulse response (IIR) filter, and a finite impulse response (FIR) filter.

Then, a sensitivity correction block (such as a sensitivity correction circuit) corrects the sensitivity of the sound signal that has been input from each microphone and has been processed. Then, a compressor corrects the signal level. As a result of the correction processing performed by the sensitivity correction block and the compressor, a gap among the signals of the channels of the respective microphones is successfully reduced.

Then, a directivity combination block (such as a directivity combination circuit) creates sound data in accordance with the directivity of sensitivity characteristics set by the user via the directivity setter 403. Specifically, if the microphone unit is a non-directional microphone unit, the directivity combination block adjusts parameters of sound data output from the microphone unit in accordance with the directivity selection information to create sound data having the directivity in a direction desired by the user.

A correction block (such as a correction circuit) then performs various kinds of correction processing on the sound data created by the directivity combination block. Examples of the correction processing include correction of a timing shift or a frequency resulting from frequency separation performed using the filters at the preceding stages. The sound data corrected by the correction block is output as a built-in microphone sound file and is stored in the sound file storage 408 as stereophonic sound data.

A sound file including stereophonic sound data can be stored in an Ambisonics format, for example. An Ambisonics-format sound file include sound data having directional components such as a W component having no directivity, an X component having a directivity in the x-axis direction, a Y component having a directivity in the y-axis direction, and a Z component having a directivity in the z-axis direction. Note that the format of the sound file described above is not limited to the Ambisonics format, and the sound file described above may be generated and stored as a stereophonic sound file of another format.

A process performed on sound signals output from the external microphone 110*b* will be described next with reference to the lower portion of FIG. 5. The external microphone connection determiner 402 determines whether the external microphone 110*b* is connected. If it is determined that the external microphone 110*b* is not connected, the following processing is skipped. On the other hand, if it is determined that the external microphone 110*b* is connected, the following processing is performed. Sound input from each of the microphones (MIC) CH5 to CH8 of the external microphone 110*b* is subjected to various kinds of signal processing by a preamplifier, an ADC, an HPF/LPF, an IIR/FIR filter, a sensitivity correction block, and a compressor. Since these various kinds of signal processing are similar to the various kinds of signal processing performed for the built-in microphone, a detailed description thereof is omitted.

After the aforementioned various kinds of signal processing are performed, the sound data is input to a directivity conversion block. The directivity conversion block converts the sound data in accordance with the directivity of sensitivity characteristics set by the user via the directivity setter 403. Specifically, when the microphone unit is a directional microphone unit, the directivity conversion block adjusts parameters of pieces of sound data output by the four microphones of the microphone unit in accordance with the directivity selection information to convert the pieces of sound data into sound data having a directivity in a direction desired by the user.

A correction block performs various kinds of correction processing on the resultant sound data obtained by the directivity conversion block. The various kinds of correction processing are similar to the various kinds of correction processing performed by the correction block for the built-in microphone. The sound data corrected by the correction block is output as an external microphone sound file and is stored as stereophonic sound data in the sound file storage 408. Note that the external microphone sound file is stored as stereophonic sound data of various formats just like the built-in microphone sound file.

The built-in microphone sound file and the external microphone sound file that have been generated and stored in the above-described manner are transferred to various reproduction apparatuses. For example, the built-in microphone sound file and the external microphone sound file can be reproduced by a reproduction apparatus, such as the head-mounted display 130, and can be listened to as stereophonic sound.

Figure 6:
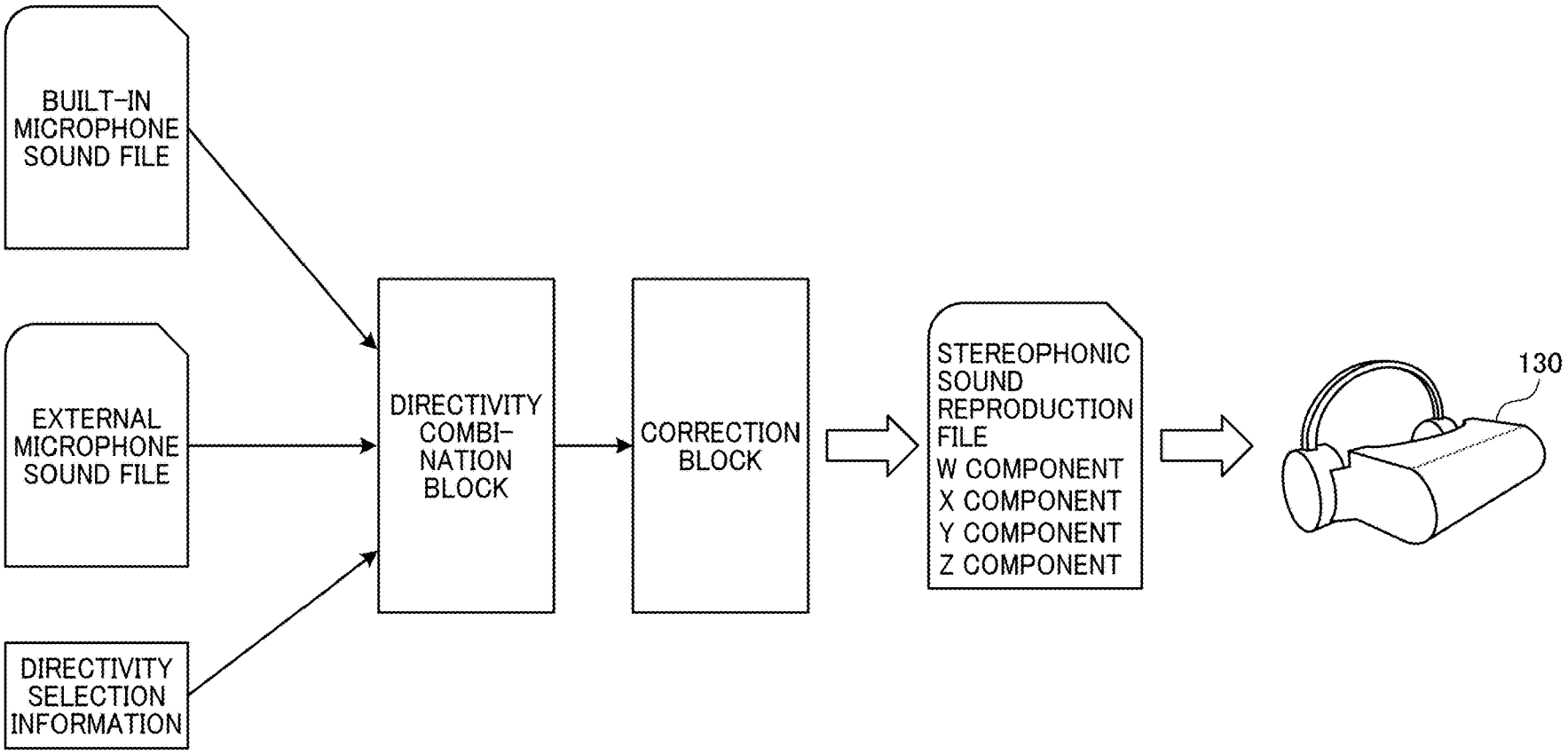
FIG. 6 is a diagram illustrating a configuration of a circuit or software that generates stereophonic sound data at the time of reproduction.

In other embodiment, stereophonic sound data having a directivity in a direction desired by the user can be generated when a captured moving image is reproduced. FIG. 6 is a diagram illustrating a circuit that processes generation of stereophonic sound data at the time of reproduction according to the embodiment. Each block in FIG. 6 corresponds to a circuit, or a process performed with software, or a combination of circuit and software.

In the embodiment illustrated in FIG. 6, the built-in microphone sound file is generated by the microphones, the preamplifier, the ADC, the HPF/LPF, the IIR/FIR filter, the sensitivity correction block, and the compressor illustrated in FIG. 5 in the similar manner. In addition, when the external microphone 110*b* is connected to the spherical camera 110*a*, the external microphone sound file is also generated in the similar manner. The built-in microphone sound file and the external microphone sound file do not have a directivity of sensitivity characteristics when the built-in microphone sound file and the external microphone sound file are generated.

Each of the generated sound files is then input to the directivity combination block. In addition, the directivity selection information set by the user via the directivity setter 403 is also input to the directivity combination block. The directivity combination block adjusts parameters of sound data included in the sound file in accordance with the directivity selection information to create sound data having a directivity in a direction desired by the user.

Then, a correction block (such as a correction circuit) performs correction processing such as correction of a timing shift or correction of a frequency on the sound data created by the directivity combination block. The sound data corrected by the correction block is output as a stereophonic sound reproduction file to a reproduction apparatus such as the head-mounted display 130 and is listened to as stereophonic sound.

The position data of the spherical camera 110*a* acquired at that time of image capturing can also be input to the directivity combination block and the directivity conversion block illustrated in FIGS. 5 and 6 in addition to the directivity selection information. The directivity is successfully maintained in a direction of a sound source desired by the user by combining or converting the directivity of sensitivity characteristics also using the position data, even when the spherical camera 110*a* is inclined or rotated during sound recording.

Figure 7A:
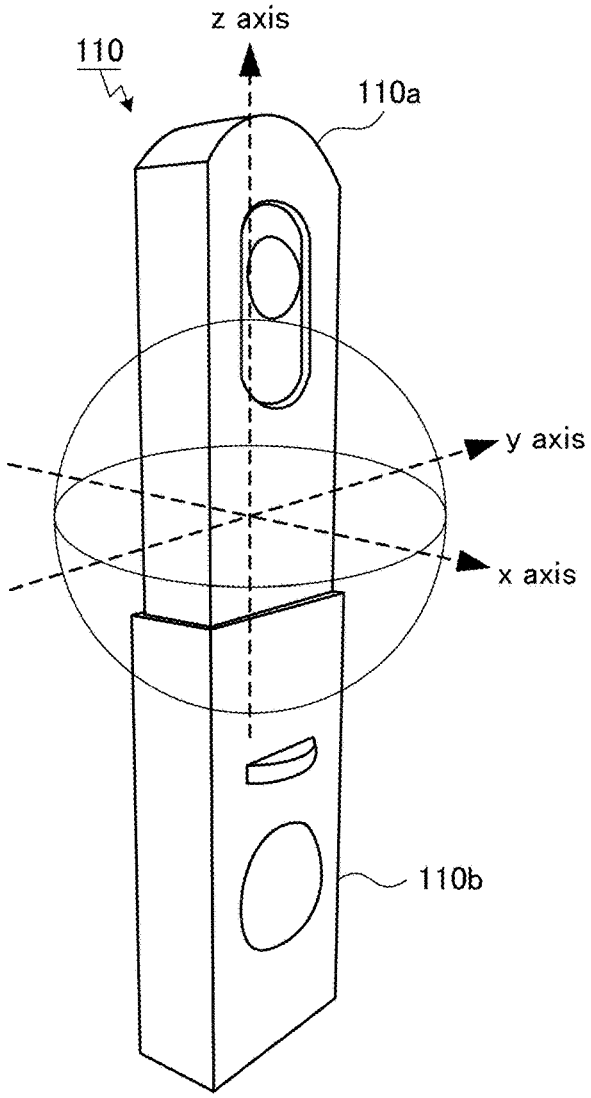
FIGS. 7A and 7B are diagrams illustrating an example of a positional relationship between a built-in microphone included in the spherical camera and an external microphone.
Figure 7B:
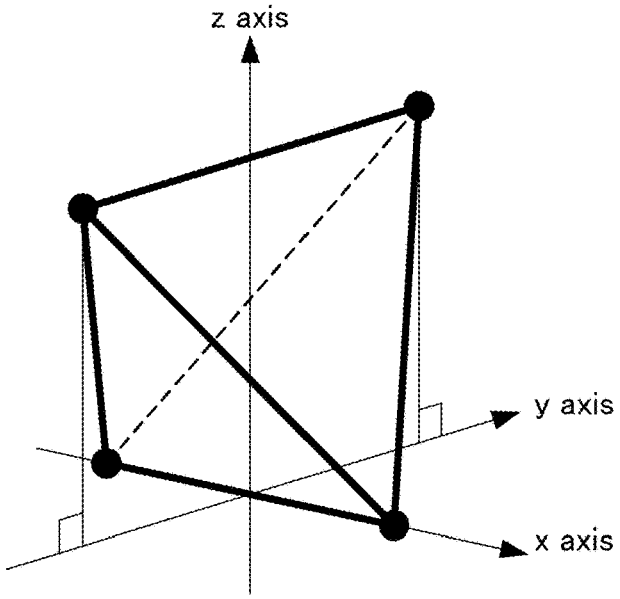

The functional blocks that perform specific processes of generating stereophonic sound data from acquired sound have been described above with reference to FIGS. 5 and 6. Acquisition of stereophonic sound in the embodiment will be described next. FIGS. 7A and 7B are diagrams illustrating an example of a positional relationship between the built-in microphone included in the spherical camera 110*a* and the external microphone 110*b*.

FIG. 7A is a diagram illustrating definitions of the x-axis, the y-axis, and the z-axis in the case where the spherical camera system 110 is in a right position. The front-rear direction, the right-left direction, and the top-bottom direction of the spherical camera system 110 are defined as the x-axis, the y-axis, and the z-axis, respectively. The spherical camera system 110 illustrated in FIG. 7A includes the built-in microphone. Further, the external microphone 110*b* is connected to the spherical camera 110*a*. The case where each of the microphone units, that is, the built-in microphone and the external microphone 110*b*, includes four microphones will be described, for example.

To efficiently acquire stereophonic sound data by using four microphones, the microphones are preferably arranged on different planes. In particular, to pick up sound in the Ambisonics format, the microphones are arranged at positions corresponding to respective vertices of a regular tetrahedron as illustrated in FIG. 7B. Sound signals acquired by the microphones arranged in this manner are particular referred to as sound signals of an A-format in the Ambisonics format. Accordingly, the microphones included in the built-in microphone of the spherical camera 110*a* according to the embodiment and the microphones included in the external microphone 110*b* are also preferably arranged in a positional relationship corresponding to the regular tetrahedron illustrated in FIG. 7B. Note that the arrangement of the microphones described in the embodiment is merely an example and does not limit the embodiment.

The sound signals acquired in this manner can be combined or converted by the signal processor 404 into a signal representation obtained in the case where sound is picked up in accordance with sound pickup directivity characteristics called B-format, and consequently a stereophonic sound file illustrated in FIGS. 5 and 6 can be generated. FIGS. 8A to 8D are diagrams illustrating examples of the directivities of the respective directional components included in an Ambisonics-format stereophonic sound file.

Figure 8A:
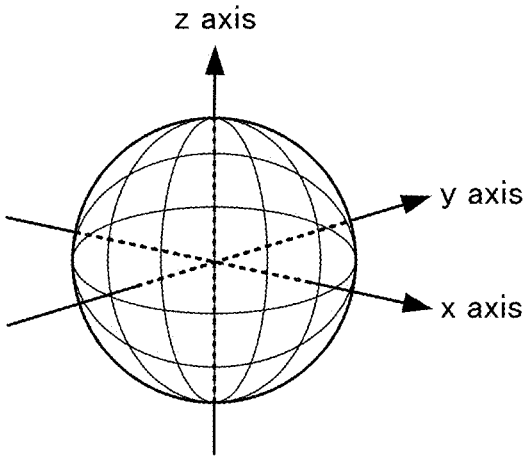
FIGS. 8A to 8D are diagrams illustrating examples of directivities of respective directional components included in a stereophonic sound file of an Ambisonics format.
Figure 8B:
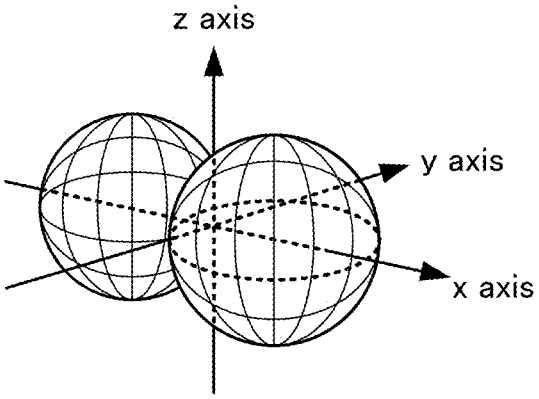
Figure 8C:
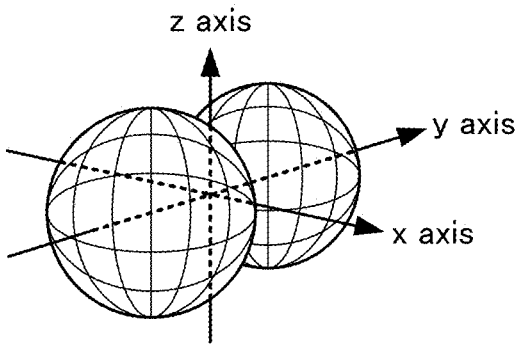
Figure 8D:
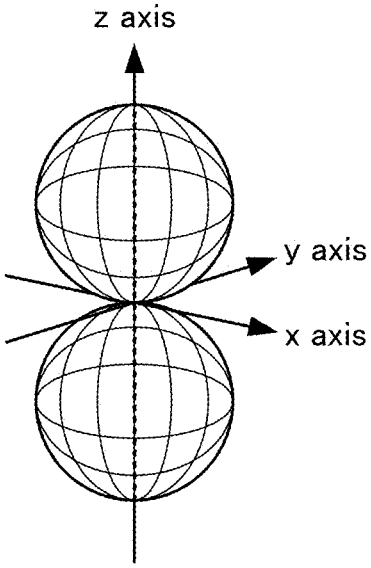

Spheres illustrated in FIGS. 8A to 8D schematically represent the sound pickup directivity in a default state. FIG. 8A indicates no directivity since the directivity is represented by a single sphere centered at the origin. FIG. 8B indicates a directivity in the x-axis direction since the directivity is represented by two spheres centered at (x, 0, 0) and (−x, 0, 0). FIG. 8C indicates a directivity in the y-axis direction since the directivity is represented by two spheres centered at (0, y, 0) and (0, −y, 0). FIG. 8D indicates a directivity in the z-axis direction since the directivity is represented by two spheres centered at (0, 0, z) and (0, 0, −z). FIGS. 8A, 8B, 8C, and 8D respectively correspond to directional components of the W component, the X component, the Y component, and the Z component of the stereophonic sound file illustrated in FIGS. 5 and 6.

In the embodiment, the user is allowed to change the directivity of sensitivity characteristics, and the resultant directivity is output as the directivity selection information. The directivity selection information indicating the directivity in a direction desired by the user is processed as parameters by the directivity combination block and the directivity conversion block when the acquired sound is combined or converted. A user operation for changing the directivity of sensitivity characteristics will be described next. FIGS. 9A to 9D are diagrams illustrating examples of a screen on which an operation for changing the directivity of sensitivity characteristics is performed in the embodiment.

FIGS. 9A to 9D illustrate an example of the screen of the user terminal 120 used to change the directivity of sensitivity characteristics of the spherical camera system 110. Diagrams on the left in FIGS. 9A to 9D are plan views of the apparatus illustrating an example of a positional relationship between the spherical camera system 110 and sound source(s). Diagrams in the middle in FIGS. 9A to 9D illustrate a user operation performed on the screen of the user terminal 120. A polar pattern of the directivity of sensitivity characteristics in the default state of the spherical camera system 110 is displayed on the screen of the user terminal 120. Diagrams on the right in FIGS. 9A to 9D illustrate the resultant polar pattern of the directivity of sensitivity characteristics after the polar pattern is changed in response to the user operation illustrated in the respective diagrams in the middle in FIGS. 9A to 9D. An input operation for enhancing the directivity in a particular direction by changing the directivity of sensitivity characteristics will be described below by using various circumstances illustrated in FIGS. 9A to 9D as examples.

Figure 9A:
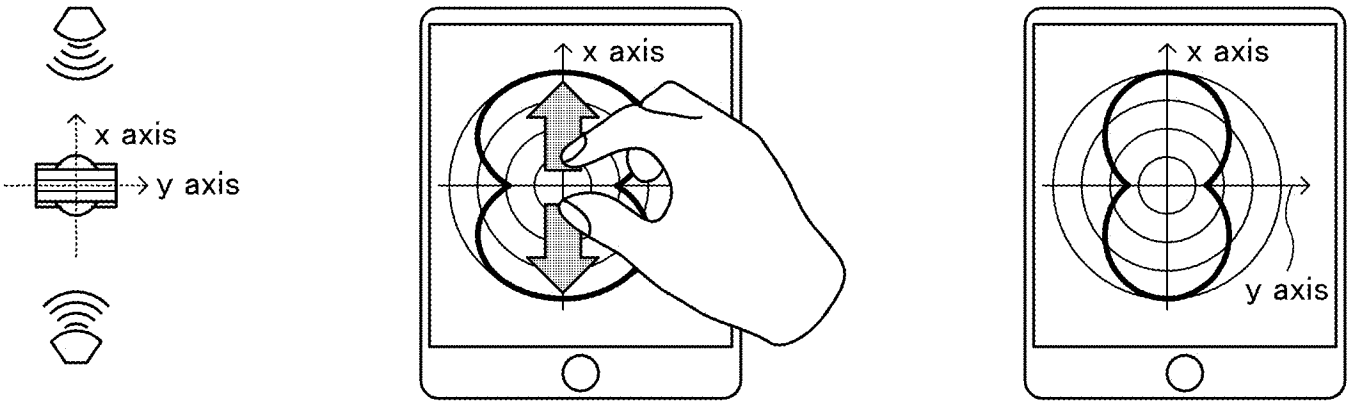
FIG. 9A to 9D are diagrams illustrating examples of a screen on which an operation for changing a directivity of sensitivity characteristics is performed in the embodiment.

The diagram on the left in FIG. 9A illustrates an example of a case where sound sources are located in the front and rear directions of the spherical camera system 110 and an operation of selecting the directivity in the directions of the sound sources is performed. In the diagram in the middle in FIG. 9A, a polar pattern on an x-y plane is displayed on the screen, and the user is performing an operation of stretching two fingers touching the screen in the upper and lower directions. As a result of such an operation, the polar pattern narrows in the y-axis direction as illustrated in the diagram on the right in FIG. 9A, and the sensitivity characteristics are successfully set to have a directivity in the x-axis direction.

Figure 9B:
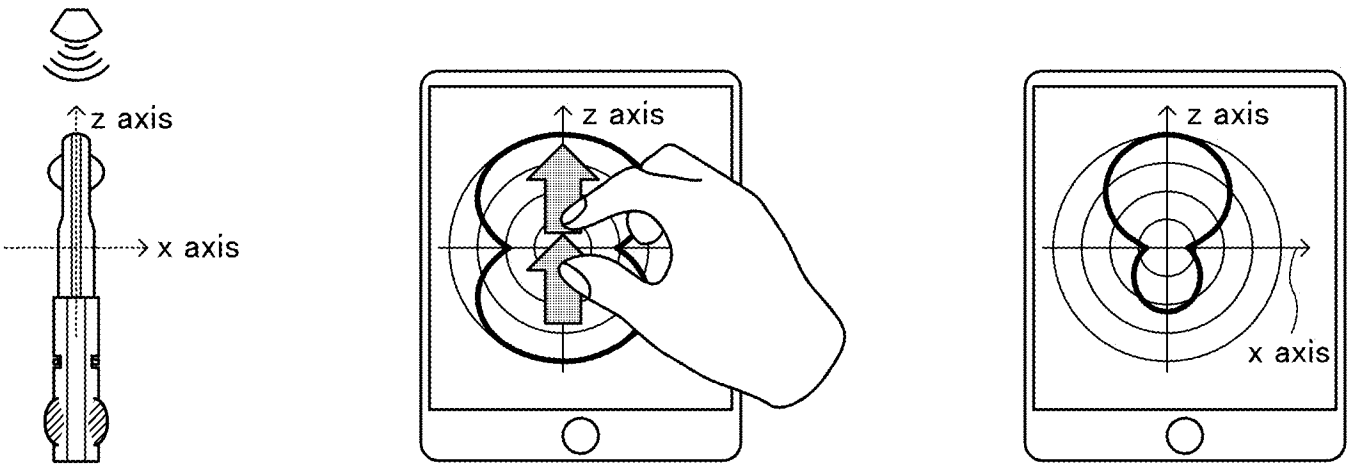

The diagram on the left in FIG. 9B illustrates an example of a case where a sound source is located above the spherical camera system 110 and an operation of selecting the directivity in the direction of the sound source is performed. In the diagram in the middle in FIG. 9B, a polar pattern on a z-x plane is displayed on the screen, and the user is performing an operation of moving the two fingers touching the screen upward. As a result of such an operation, the polar pattern extends in the positive z-axis direction as illustrated in the diagram on the right in FIG. 9B, and the sensitivity characteristics are successfully set to have a directivity in one direction of the z-axis direction.

Figure 9C:
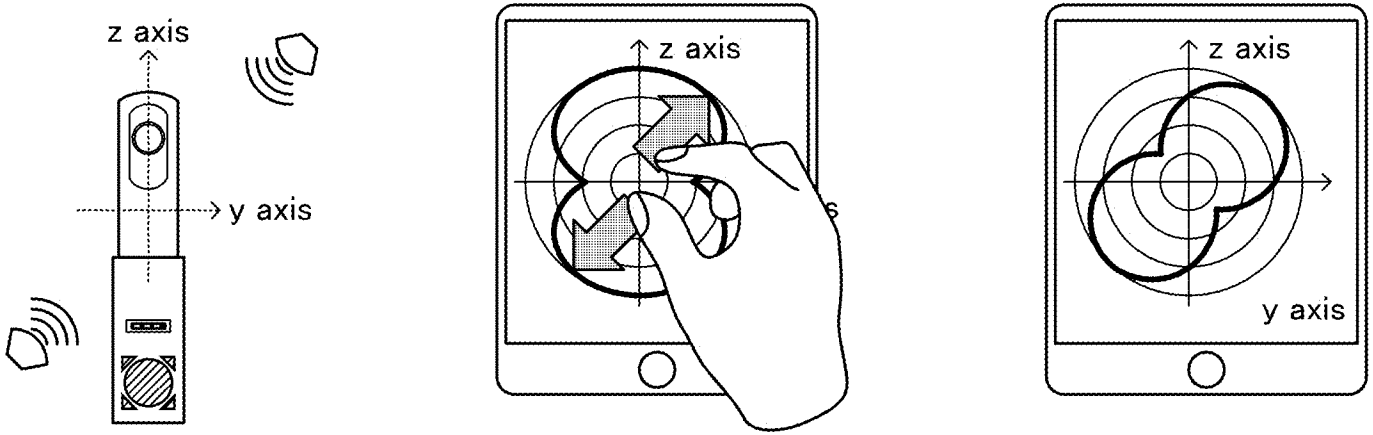

The diagram on the left in FIG. 9C illustrates an example of a case where sound sources are located in a left-bottom direction and a right-top direction when the spherical camera system 110 is viewed from the front and an operation of selecting the directivity in the directions of the sound sources is performed. In the diagram in the middle in FIG. 9C, a polar pattern on a y-z plane is displayed on the screen, and the user is performing an operation of stretching the two fingers touching the screen in the lower left direction and the upper right direction. As a result of such an operation, the polar pattern can be changed as illustrated in the diagram on the right in FIG. 9C, and the sensitivity characteristics are successfully set to have a directivity in a direction from the upper right portion to the lower left portion on the y-z plane.

Figure 9D:
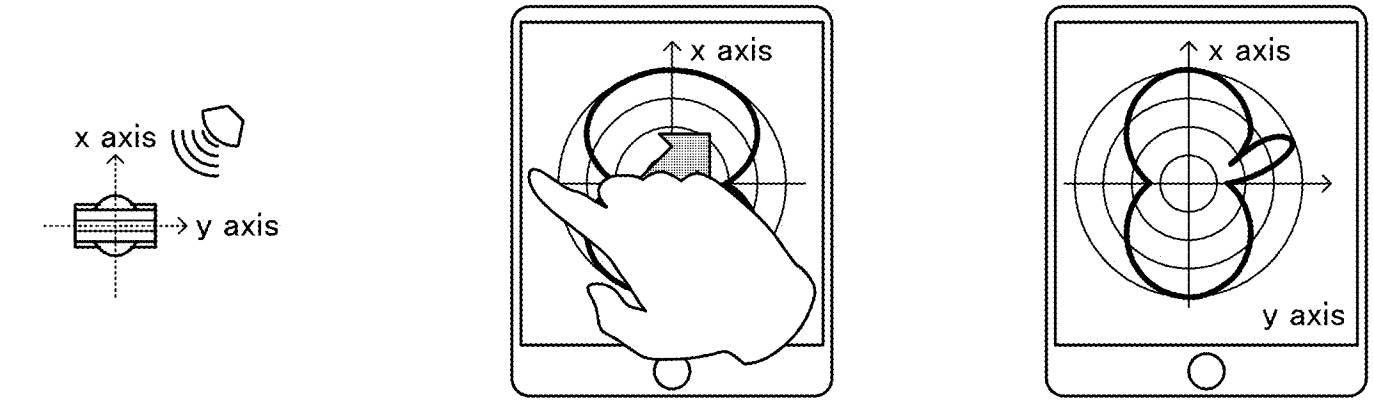

The diagram on the left in FIG. 9D illustrates an example of a case where a sound source is located in the right-front direction of the spherical camera system 110 and an operation of selecting the directivity in the direction of the sound source is performed. In the diagram in the middle in FIG. 9D, a polar pattern on an x-y plane is displayed on the screen and the user is performing an operation of moving a finger touching the screen in the upper right direction. As a result of such an operation, the polar pattern can be changed to have a directivity in the upper right direction on the x-y plane as illustrated in the diagram on the right in FIG. 9D, and the sensitivity characteristics are successfully set to have a sharp directivity in the direction of the sound source.

The user changes the directivity of sensitivity characteristics in the above-described manner. Consequently, the directivity setter 403 outputs the directivity selection information corresponding to the resultant polar pattern. In the embodiment, since the user performs an operation on a polar pattern diagram displayed on the screen, the user can change the directivity of sensitivity characteristics while visually understanding the change easily. Although operations performed on a touch panel display are illustrated in the examples of FIGS. 9A to 9D, the operations are not limited to these operations and may be operations performed using another method, for example, operations performed using a mouse. In addition, the operations of changing the directivity of sensitivity characteristics are not limited to the operations illustrated in FIGS. 9A to 9D, and the directivity selection information indicating a directivity in a direction desired by the user can be generated through various operations.

Figure 10A:
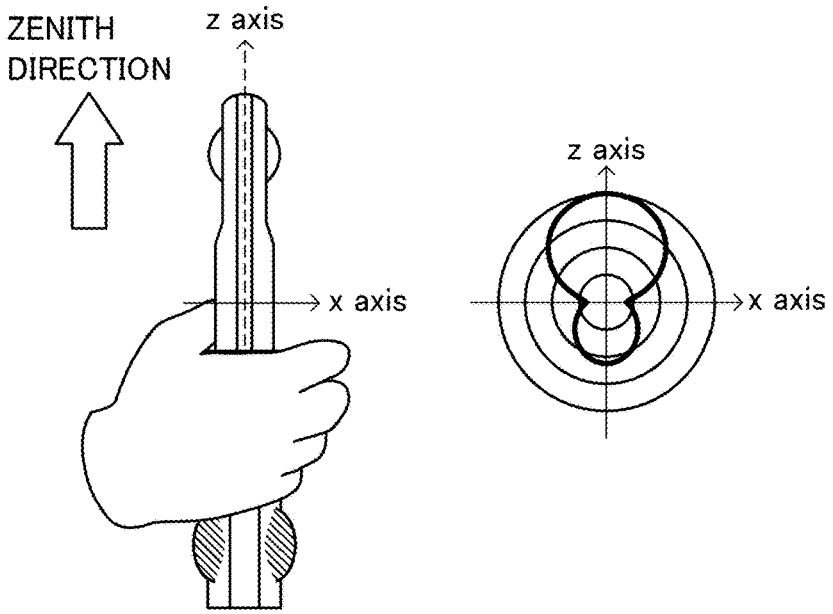
FIGS. 10A to 10C are diagrams illustrating a directivity when the position of the spherical camera system is changed in the embodiment.
Figure 10B:
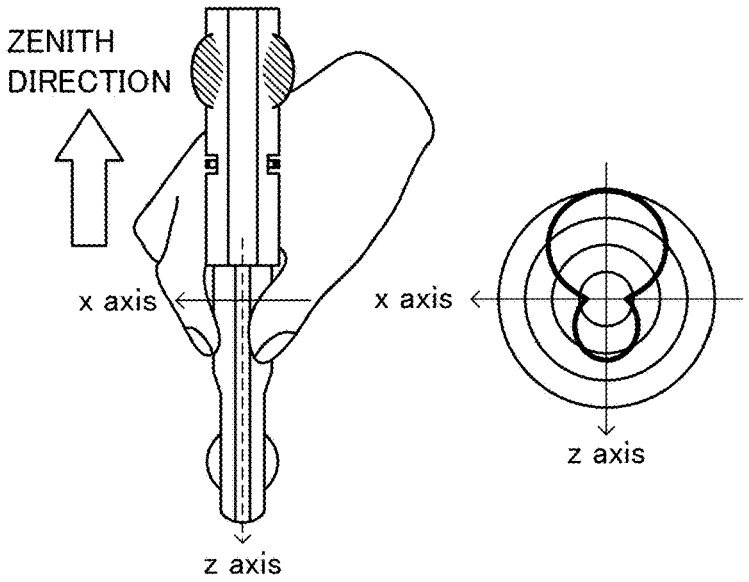
Figure 10C:
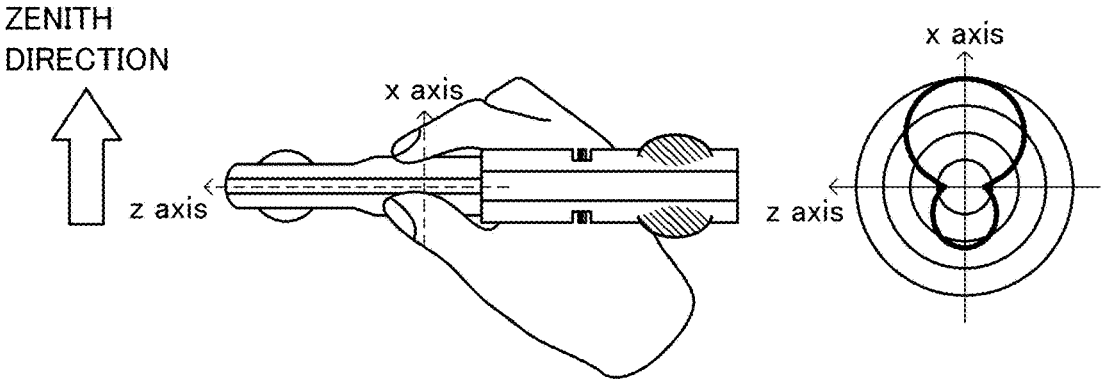

In addition, in the embodiment, the position of the spherical camera system 110 is acquired and the zenith information is recorded. With such a configuration, the directivity of sensitivity characteristics desired by the user is successfully maintained even when the position of the spherical camera system 110 changes during image capturing. FIGS. 10A to 10C are diagrams illustrating the directivity when the position of the spherical camera system 110 changes in the embodiment. FIGS. 10A to 10C will be described by using the directivity of sensitivity characteristics illustrated in the diagram on the right in FIG. 9B, for example.

A diagram on the left in FIG. 10A illustrates a case where the spherical camera system 110 is in a right position, which is a default state and is the same as the position illustrated in FIG. 9B. In this state, the user selects the directivity as in the polar pattern illustrated in the diagram on the right in FIG. 9B and selects a mode in which recording is performed with the zenith direction fixed. Thus, the directivity of sensitivity characteristics illustrated in a diagram on the right in FIG. 10A is substantially the same as that of FIG. 9B.

Suppose that the user performs an operation for recording the zenith direction and then changes the position of the spherical camera system 110 as illustrated in FIGS. 10B and 10C. For example, even when the position of the spherical camera system 110 is changed upside down as illustrated in a diagram on the left in FIG. 10B, since the zenith direction is fixed, the polar pattern has a shape in which the directivity extends toward the negative z-axis direction as illustrated in a diagram on the right in FIG. 10B. Consequently, sound from a sound source located in the zenith direction is successfully picked up.

In addition, when the spherical camera system 110 is inclined in the lateral direction by 90° as illustrated in a diagram on the left in FIG. 10C, the x-axis direction corresponds to the zenith direction. Thus, the polar pattern in this case has a shape in which the directivity extends towards the positive x-axis direction as illustrated in a diagram on the right in FIG. 10C. Consequently, sound from a sound source located in the zenith direction is successfully picked up as in FIG. 10B.

In the embodiment, the position data of the spherical camera system 110 is acquired and sound is recorded with the zenith direction fixed in this way. Thus, even when the position of the spherical camera system 110 changes during image capturing, the directivity of sensitivity characteristics is successfully maintained in a direction of a sound source and sound from a direction desired by the user is successfully picked up. Although the description has been given of the case where the position of the spherical camera system 110 is inclined by 90° and by 180° relative to the right position by way of example in FIGS. 10A to 10C, the position of the spherical camera system 110 may be inclined by a given angle.

Figure 11:
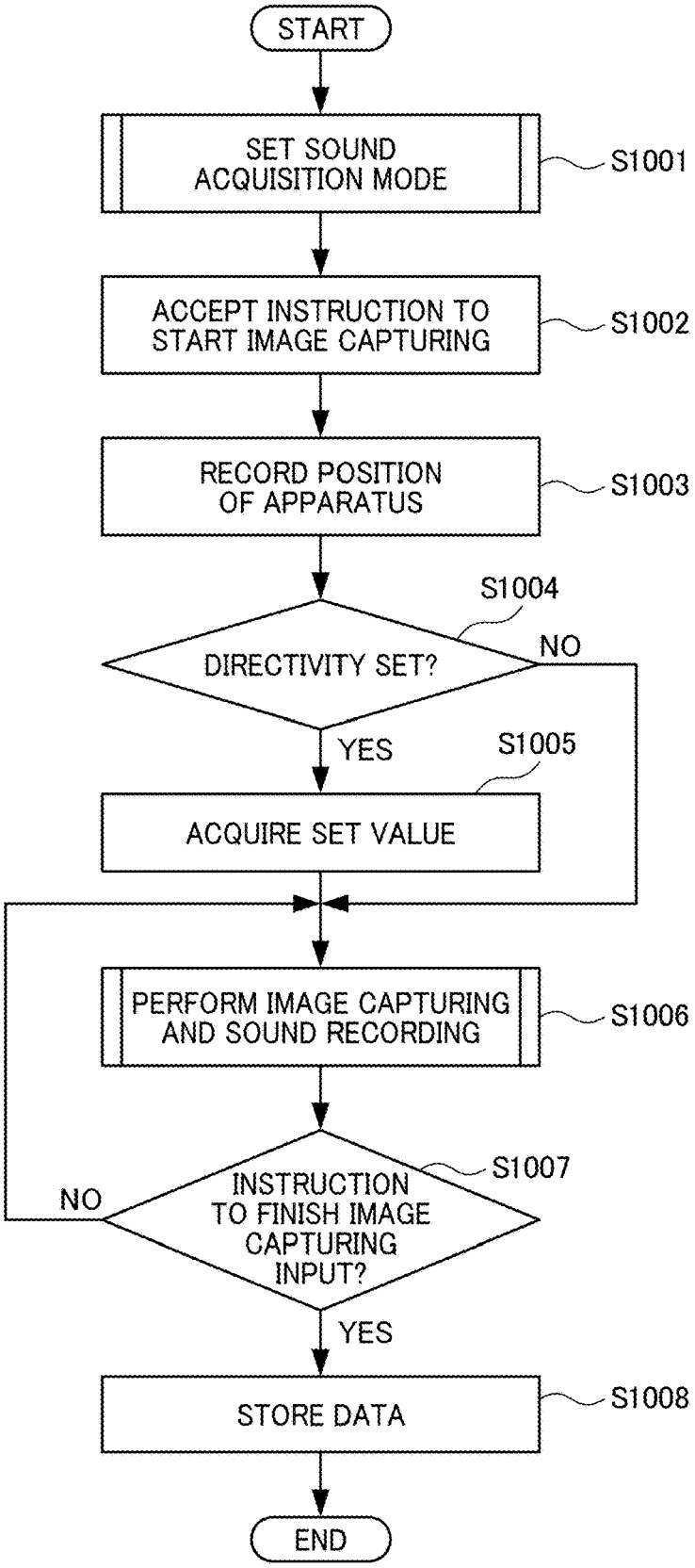
FIG. 11 is a flowchart of a process of capturing a video image including stereophonic sound according to the embodiment.

The change in the directivity of sensitivity characteristics and the position of the spherical camera system 110 during image capturing have been described above. A specific process performed in the embodiment will be described next with reference to FIG. 11. FIG. 11 is a flowchart of a process of capturing a video image including stereophonic sound in the embodiment.

In step S1001, the sound acquisition mode is set. Examples of the settings made in step S1001 include a setting regarding whether the external microphone 110*b* is connected and a setting regarding directivity selection information. Details of these settings will be described later.

In addition, the spherical camera 110*a* acquires sound from the surrounding environment during booting or various settings, for example, and compares signals from the respective microphones included in the microphone unit. If a defect is detected, the spherical camera 110*a* is capable of issuing an alert to the user. For example, a defect is detected in a following manner. When sound signals are output from three microphones among four microphones included in the microphone unit but a signal from the other microphone has a low signal level, it is determined that a defect has occurred in the microphone. When a signal from at least one of the microphones has a low output level or a microphone is covered, directivity conversion or combination may not be performed appropriately and consequently preferable stereophonic sound data may not be generated. Thus, upon detecting a defect in a signal of at least one of the microphones as described above, the spherical camera 110*a* displays an alert notifying the user of the occurrence of a defect on the user terminal 120 and prompts the user to cope with the defect. Note that the above-described processing may be performed during image capturing.

Then, in step S1002, the user inputs an instruction to start image capturing to the spherical camera 110*a*. The instruction may be input by the user in step S1002 in the following manner. For example, the user may press an image-capturing button included in the spherical camera 110*a*. Alternatively, an instruction to start image capturing may be transmitted to the spherical camera 110*a* via an application installed on the user terminal 120.

In response to acceptance of the instruction to start image capturing in step S1002, the spherical camera 110*a* acquires position data, defines information regarding the zenith direction, and records the information regarding the zenith direction in step S1003. Since the information regarding the zenith direction is defined in step S1003, the spherical camera system 110 successfully acquires sound in a direction desired by the user even when the position of the spherical camera system 110 changes during image capturing.

Then, in step S1004, the spherical camera system 110 determines whether the current mode is a mode in which the directivity of sensitivity characteristics is set with reference to the mode set in step S1001. If the directivity is set (YES in step S1004), the process branches to step S1005. The set directivity selection information is acquired in step S1005, and the process then proceeds to step S1006. If the directivity is not set (NO in step S1004), the process branches to step S1006.

In step S1006, image capturing and sound recording are performed in the set mode. In step S1007, it is determined whether an instruction to finish image capturing is accepted. An instruction to finish image capturing may be input by the user, for example, by pressing the image-capturing button of the spherical camera 110*a* as in the case of input of an instruction to start image capturing in step S1002. If an instruction to finish image capturing is not accepted (NO in step S1007), the process returns to step S1006 and image capturing and sound recording are continued. If an instruction to finish image capturing is accepted (YES in step S1007), the process proceeds to step S1008.

In step S1008, image data and sound data are stored in the storage device 314 of the spherical camera 110*a*. Note that the sound data can be subjected to directivity combination or directivity conversion and can be stored in the sound file storage 408 as stereophonic sound data.

Figure 12:
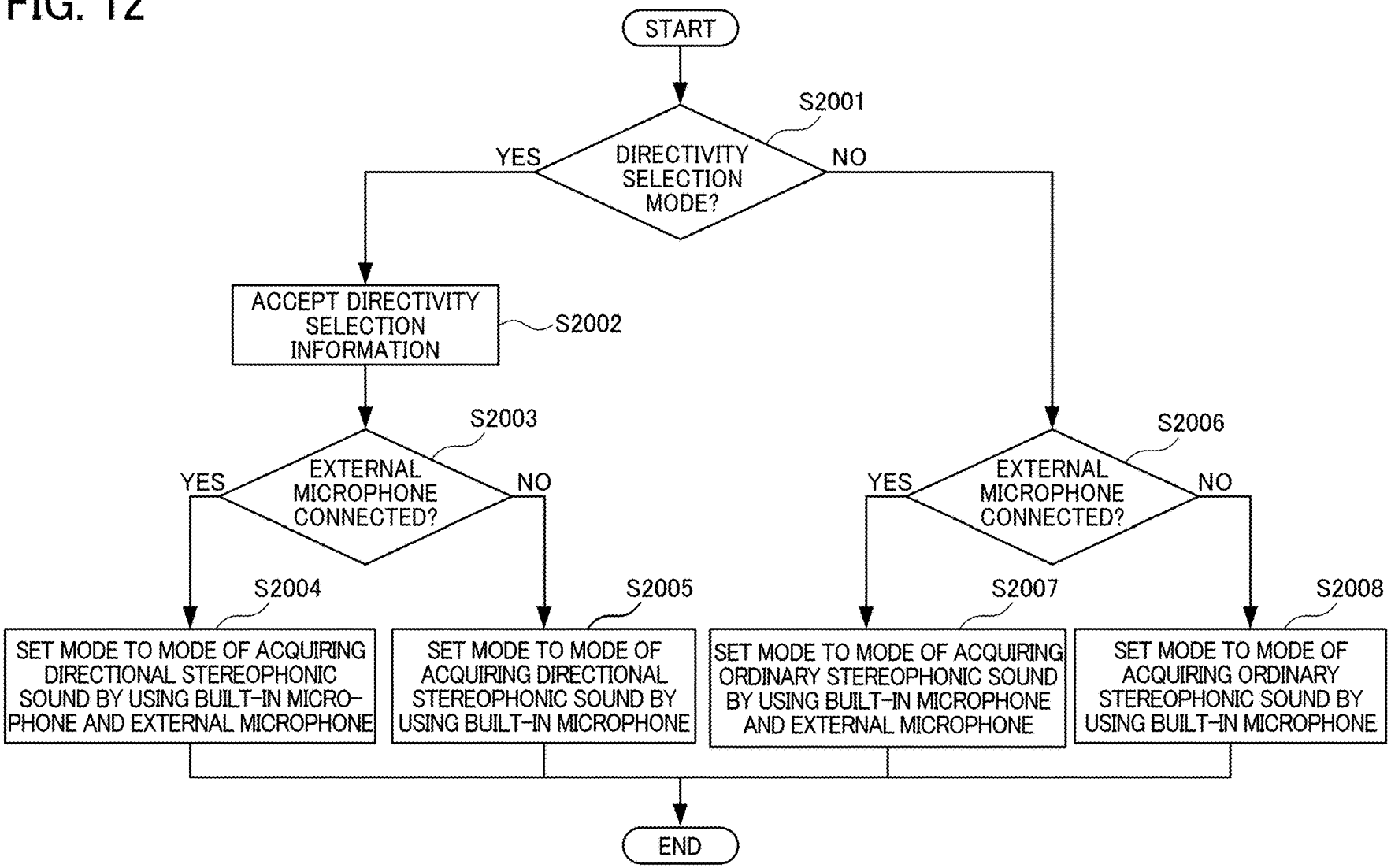
FIG. 12 is a flowchart of a process of setting a sound acquisition mode according to the embodiment.

Through the process described above, the spherical camera system 110 is able to acquire an image and sound. Details of the setting of the sound acquisition mode performed in step S1001 will be described next. FIG. 12 is a flowchart of a process of setting the sound acquisition mode in the embodiment. FIG. 12 corresponds to the processing in step S1001 of FIG. 11.

In step S2001, the sound recording mode is selected from a mode of acquiring stereophonic sound with the sensitivity characteristics of each microphone specified in a particular direction and a mode of acquiring ordinary stereophonic sound. If the mode of acquiring stereophonic sound with the sensitivity characteristics of each microphone specified in a particular direction is selected (YES in step S2001), the process branches to S2002. If the mode of acquiring ordinary stereophonic sound is selected (NO in step S2001), the process branches to step S2006.

In step S2002, an input of the directivity selection information is accepted. The directivity selection information can be set in the following manner, for example. As described above, the user terminal 120 displays an operation screen with a polar pattern. For example, the user may execute a specific application, which cooperates with the spherical camera 110*a*, to display the operation screen. The user performs an operation on the user terminal 120 to change the polar pattern of the directivity of the sensitivity characteristics as illustrated in FIGS. 9A to 9D. Through the operation performed in step S2002, the user can change the directivity in a direction of a particular sound source and can set the directivity easily. The instruction for changing the directivity, as indicated by the change in the polar pattern, is transmitted to the spherical camera 110*a*.

Then, in step S2003, the external microphone connection determiner 402 determines whether the external microphone 110*b* is connected to the spherical camera 110*a*. If the external microphone 110*b* is connected (YES in step S2003), the process proceeds to step S2004. If the external microphone 110*b* is not connected (NO in step S2003), the process proceeds to step S2005.

In step S2004, the sound acquisition mode is set to a mode of acquiring stereophonic sound with the directivity set in the selected direction by using both the built-in microphone and the external microphone 110*b*. The process then ends to proceed to S1002 of FIG. 11.

In step S2005, the sound acquisition mode is set to a mode of acquiring stereophonic sound with the directivity set in the selected direction by using the built-in microphone. The process then ends to proceed to S1002 of FIG. 11.

The case where the mode of acquiring ordinary stereophonic sound is selected in step S2001 (NO in step S2001) will be described. Subsequently to step S2001, the process branches to step S2006. In step S2006, the external microphone connection determiner 402 determines whether the external microphone 110*b* is connected to the spherical camera 110*a*. Note that the processing in step S2006 can be performed in a manner similar to the processing in step S2003. If the external microphone 110*b* is connected (YES in step S2006), the process proceeds to step S2007. If the external microphone 110*b* is not connected (NO in step S2006), the process proceeds to step S2008.

In step S2007, the sound acquisition mode is set to a mode of acquiring ordinary stereophonic sound by using both the built-in microphone and the external microphone 110*b*. The process then ends to proceed to S1002 of FIG. 11.

In step S2008, the sound acquisition mode is set to a mode of acquiring ordinary stereophonic sound by using the built-in microphone. The process then ends to proceed to S1002 of FIG. 11.

Through the process described above, the sound acquisition mode is successfully set. The set sound acquisition mode can be used as a criterion of the determination processing performed in step S1004 of FIG. 11. In addition, the directivity selection information input in step S2002 is referred to as a set value in step S1005 and is used as a parameter when stereophonic sound is acquired.

According to the embodiment of the present invention described above, an apparatus, a system, a method, and a control program stored in a recording medium, each of which enables addition of a sense of realism desired by the user and addition of the expression unique to the user can be provided.

Each of the functions according to the embodiment of the present invention described above can be implemented by a program that is written in C, C++, C#, Java (registered trademark), or the like and that can be executed by an apparatus. The program according to the embodiment can be recorded and distributed on an apparatus-readable recording medium, such as a hard disk drive, a Compact Disc-Read Only Memory (CD-ROM), a magneto-optical disk (MO), a Digital Versatile Disc (DVD), a flexible disk, an electrically erasable programmable ROM (EEPROM), or an erasable programmable ROM (EPROM) or can be transmitted via a network in a format receivable by other apparatuses.

The above-described embodiments are illustrative and do not limit the present invention. Thus, numerous additional modifications and variations are possible in light of the above teachings. For example, elements and/or features of different illustrative embodiments may be combined with each other and/or substituted for each other within the scope of the present invention.

For example, the spherical image, either a still image or video, does not have to be the full-view spherical image. For example, the spherical image may be the wide-angle view image having an angle of about 180 to 360 degrees in the horizontal direction.

Each of the functions of the described embodiments may be implemented by one or more processing circuits or circuitry. Processing circuitry includes a programmed processor, as a processor includes circuitry. A processing circuit also includes devices such as an application specific integrated circuit (ASIC), digital signal processor (DSP), field programmable gate array (FPGA), and conventional circuit components arranged to perform the recited functions.

In one embodiment, the present invention may reside in a method including: obtaining sound data based on a plurality of sound signals respectively output from a plurality of microphones; receiving a user instruction for enhancing directivity of sensitivity characteristics of at least one of the plurality of microphones in a specific direction; and generating sound data having the directivity in the specific direction, based on the obtained sound data.

In one embodiment, the present invention may reside in a non-transitory recording medium which, when executed by one or more processors, cause the processors to perform a method including: obtaining sound data based on a plurality of sound signals respectively output from a plurality of microphones; receiving a user instruction for enhancing directivity of sensitivity characteristics of at least one of the plurality of microphones in a specific direction; and generating sound data having the directivity in the specific direction, based on the obtained sound data.

The invention claimed is:

1. A data processing apparatus comprising:

processing circuitry configured to, obtain sound data based on a plurality of sound signals respectively output from a plurality of microphones, generate, based on the sound data, enhanced sound data having a directivity in a specific direction such that the directivity in the enhanced sound data is maintained in the specified direction in response to movement of one or more of the plurality of microphones while capturing the plurality of sound signals, combine a plurality of images captured with an image capturing device and information indicating an inclination angle of the plurality of microphones relative to a reference direction, and store, in a memory, the enhanced sound data having the directivity in the specific direction in association with at least the plurality of images and the information indicating the inclination angle of the plurality of microphones relative to the reference direction.

2. The data processing apparatus of claim 1, wherein the processing circuitry is further configured to, control a display to display a polar pattern that reflects the directivity of sensitivity characteristics of at least one of the plurality of the microphones in the specific direction, set directivity selection information for enhancing the directivity in the specific direction in response to a change in a shape of the polar pattern, and convert the sound data of the plurality of sound signals according to the directivity selection information, to generate the enhanced sound data having the directivity in the specific direction.

3. The data processing apparatus of claim 2, wherein the enhanced sound data having the directivity in the specific direction is stereophonic sound data.

4. The data processing apparatus of claim 2, wherein the processing circuitry is further configured to, receive a user instruction for enhancing the directivity of the sensitivity characteristics of at least one of the plurality of microphones in the specific direction, the user instruction being a user operation to change the shape of the polar pattern displayed on the display.

5. The data processing apparatus of claim 1, wherein the plurality of microphones includes one or more built-in microphones incorporated in the data processing apparatus, and one or more external microphones connected to the data processing apparatus.

6. The data processing apparatus of claim 5, wherein the enhanced sound data having the directivity includes sound data generated based on the built-in microphones, and sound data generated based on the external microphones.

7. The data processing apparatus of claim 5, wherein the processing circuitry is configured to, combine sound data generated based on the built-in microphones and sound data generated based on the external microphones into combined sound data, and generate the enhanced sound data having the directivity based on the combined sound data.

8. A system comprising:

the data processing apparatus of claim 1; and an information processing apparatus communicably connected with the data processing apparatus, the information processing apparatus including, a display configured to display a polar pattern that reflects the directivity of sensitivity characteristics of the plurality of microphones; and processing circuitry configured to transmit a change in a shape of the polar pattern to the data processing apparatus for enhancing the directivity.

9. The system of claim 8, further comprising:

a reproduction apparatus communicably connected with the data processing apparatus, the reproduction apparatus including a speaker configured to output sounds based on the enhanced sound data having the directivity in the specific direction.

10. The data processing apparatus of claim 1, wherein the image capturing device includes the one or more of the plurality of microphones such that the processing circuitry is configured to maintain the directivity in the enhanced sound data in the specified direction irrespective of a change in the inclination angle of the image capturing device.

11. A system comprising:

processing circuitry configured to, obtain sound data based on a plurality of sound signals respectively output from a plurality of microphones, generate, based on the sound data, enhanced sound data having a directivity in a specific direction such that the directivity in the enhanced sound data is maintained in the specified direction in response to movement of one or more of the plurality of microphones while capturing the plurality of sound signals, combine a plurality of images captured with an image capturing device and information indicating an inclination angle of the plurality of microphones relative to a reference direction, and store, in a memory, the enhanced sound data having the directivity in the specific direction in association with at least the plurality of images and the information indicating the inclination angle of the plurality of microphones relative to the reference direction.

12. The system of claim 11, wherein the processing circuitry is further configured to, control a display to display a polar pattern that reflects the directivity of sensitivity characteristics of at least one of the plurality of the microphones in the specific direction, and set directivity selection information for enhancing the directivity in the specific direction in response to a change in a shape of the polar pattern.

13. The system of claim 12, wherein the processing circuitry is further configured to output sounds based on the enhanced sound data having the directivity in the specific direction.

14. The system of claim 11, wherein the image capturing device includes the one or more of the plurality of microphones such that the processing circuitry is configured to maintain the directivity in the enhanced sound data in the specified direction irrespective of a change in the inclination angle of the image capturing device.

15. A method of controlling data processing, comprising:

obtaining sound data based on a plurality of sound signals respectively output from a plurality of microphones;

generating, based on the sound data, enhanced sound data having a directivity in a specific direction such that the directivity in the enhanced sound data is maintained in the specified direction in response to movement of one or more of the plurality of microphones while capturing the plurality of sound signals;

combining a plurality of images captured with an image capturing device and information indicating an inclination angle of the plurality of microphones relative to a reference direction; and storing, in a memory, the enhanced sound data having the directivity in the specific direction in association with at least the plurality of images and the information indicating the inclination angle of the plurality of microphones relative to the reference direction.

16. The method of claim 15, further comprising:

displaying a polar pattern that reflects the directivity of sensitivity characteristics of the plurality of microphones; and setting directivity selection information for enhancing the directivity in the specific direction in response to a change in a shape of the polar pattern.

17. The method of claim 15, wherein the image capturing device includes the one or more of the plurality of microphones such that the generating generates the enhanced sound data maintains the directivity in the enhanced sound data in the specified direction irrespective of a change in the inclination angle of the image capturing device.

* * * * *